US005595294A

United States Patent [19]

McKenzie et al.

[11] Patent Number: 5,595,294

[45] Date of Patent: Jan. 21, 1997

[54] MODULAR PACKAGING AND HOLDER FOR TOOL BITS

[76] Inventors: Archibald M. McKenzie, 9260 Oak Street, Vancouver, B.C., Canada, V6P 4C1; Paul D. McKenzie, 6781 Mariue Drive, Vancouver, B.C., Canada, V7W 2T1; Robert Suter, #328 - 8500 Ackroyd Rd., Richmond, B.C., Canada, V6X 3H8

[21] Appl. No.: 381,926

[22] PCT Filed: Aug. 16, 1993

[86] PCT No.: PCT/CA93/00325

§ 371 Date: Apr. 12, 1995

§ 102(e) Date: Apr. 12, 1995

[87] PCT Pub. No.: WO94/04323

PCT Pub. Date: Mar. 3, 1994

[30] Foreign Application Priority Data

Aug. 14, 1992 [CA] Canada ..... 2076223

[51] Int. Cl.[6] ..... B65D 85/20; A45C 11/26

[52] U.S. Cl. ..... 206/349; 206/379; 206/775; 220/234

[58] Field of Search ..... 206/349, 379, 206/446, 443, 45.14, 45.31, 775; 220/23.4

[56] References Cited

U.S. PATENT DOCUMENTS

| | | | |
|---|---|---|---|
| 4,069,915 | 1/1978 | Schurman | 206/349 X |
| 4,260,057 | 4/1981 | Wall-Anderson | 206/379 |
| 4,372,445 | 2/1983 | Keffeler . | |
| 4,402,423 | 9/1983 | Skowronski et al. | 206/379 X |
| 4,867,305 | 9/1989 | Schneider | 206/379 X |
| 4,880,122 | 11/1989 | Martindell . | |
| 4,909,386 | 3/1990 | Jeffers | 206/379 |
| 4,924,733 | 5/1990 | McKenzie . | |
| 5,148,914 | 9/1992 | Budert | 206/379 X |
| 5,291,996 | 3/1994 | Linden | 206/349 |
| 5,363,957 | 11/1994 | Reichner | 206/349 |

FOREIGN PATENT DOCUMENTS

| | | | |
|---|---|---|---|
| 0362124 | 4/1989 | European Pat. Off. . | |
| 2736215 | 2/1979 | Germany | 206/379 |
| 1553549 | 9/1979 | United Kingdom . | |
| 2185238 | 7/1987 | United Kingdom . | |

*Primary Examiner*—Bryon P. Gehman
*Attorney, Agent, or Firm*—Oyen, Wiggs, Green and Mutala

[57] ABSTRACT

The present invention provides a modular bit holder which stores and displays a single bit, and can be linked with other such bit holders to form a variable set. A bit is inserted in one end of the holder and is held in place by a flange. To remove the bit, a second bit is forced into the holder, displacing the first bit to a holding position from which it can be removed. Each holder has means along either side of it to removably attach it in side-by-side fashion to another similar holder.

12 Claims, 6 Drawing Sheets

MODULAR PACKAGING AND HOLDER FOR TOOL BITS

TECHNICAL FIELD

The invention relates to holders and packaging for elongated objects such as drill bits, screwdriver bits and the like.

BACKGROUND ART

Typically tool bits, such as power drill bits, are sold in sets of 8 to 12 bits of sequential sizes, carried in a plastic carrying case which also functions to store the bits at the owner's workbench. A problem with such an approach to the marketing of bits is that it restricts the purchaser's flexibility in the selection and storing of various bit sizes. For example, a purchaser will be forced to acquire separately a size of bit not included in the pre-packaged selection and will be unable to store the bit in the plastic package which contains the initial set.

Other tool bits are also amenable to sale and storage in sets, such as screwdriver bits for power drivers or for multiple-bit screwdrivers, such as those sold under the trade-mark PIC-QUIC™ which is disclosed in U.S. Pat. No. 4,924,733. Currently there is no convenient means for vending and storing such bits in variable sets.

There is therefore a need for a convenient means for vending and storing tool bits singly or in variable sets.

DISCLOSURE OF INVENTION

The present invention discloses a modular bit holder which stores and displays a single bit, and can be linked with other such bit holders to form a variable set. A bit is inserted in one end of the holder, and is held temporarily in place by a spring or other means. To remove the bit, a second bit is forced into the holder, displacing the first bit to a holding position from which it can be removed. Each holder has means along either side of it to removably attach it in side-by-side fashion to another similar holder.

BRIEF DESCRIPTION OF DRAWINGS

In drawings which disclose a preferred embodiment of the invention.

BEST MODE(S) FOR CARRYING OUT THE INVENTION

Figure 1:
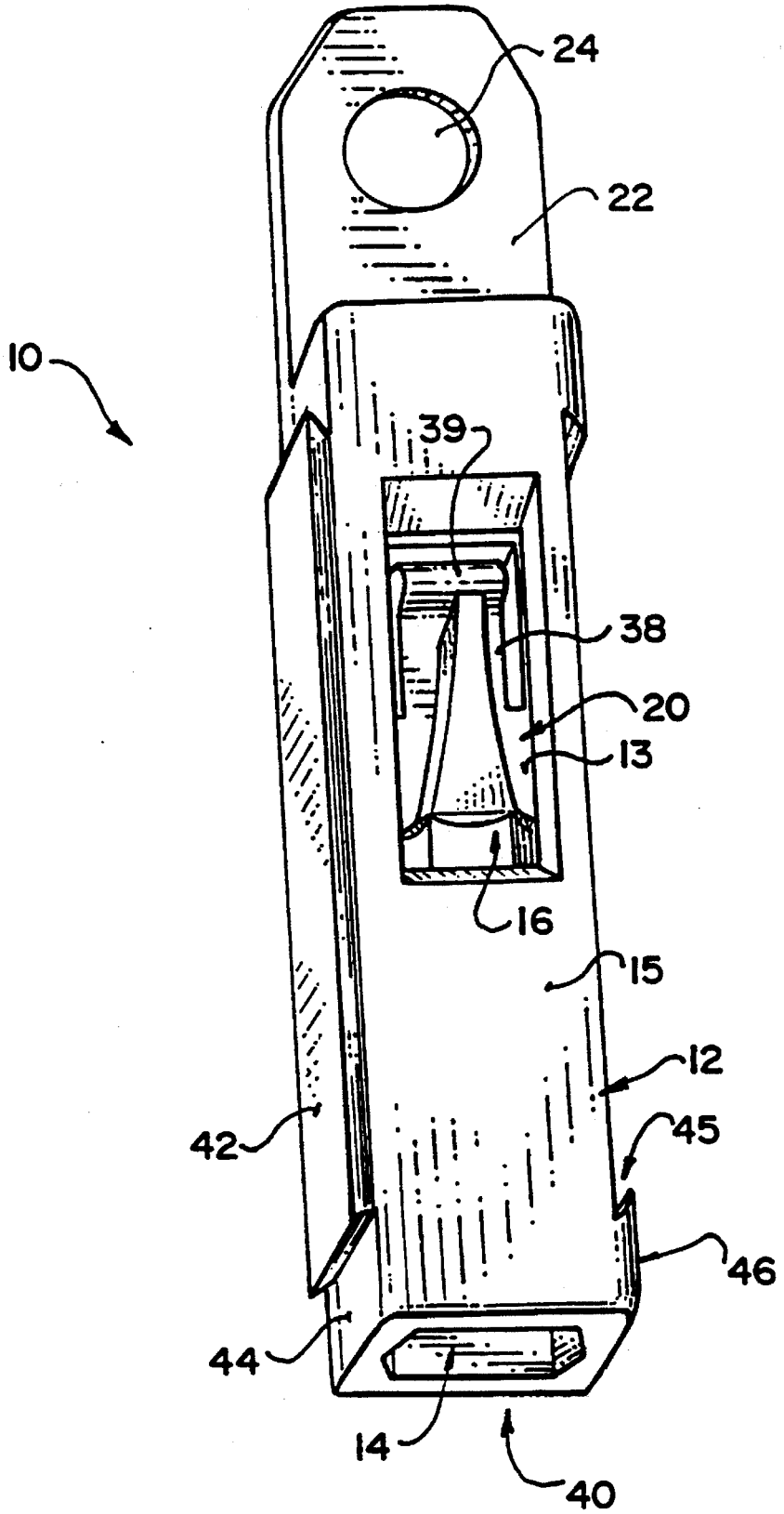
FIG. 1 is a perspective view of a first embodiment of the invention holding a bit.
Figure 2:
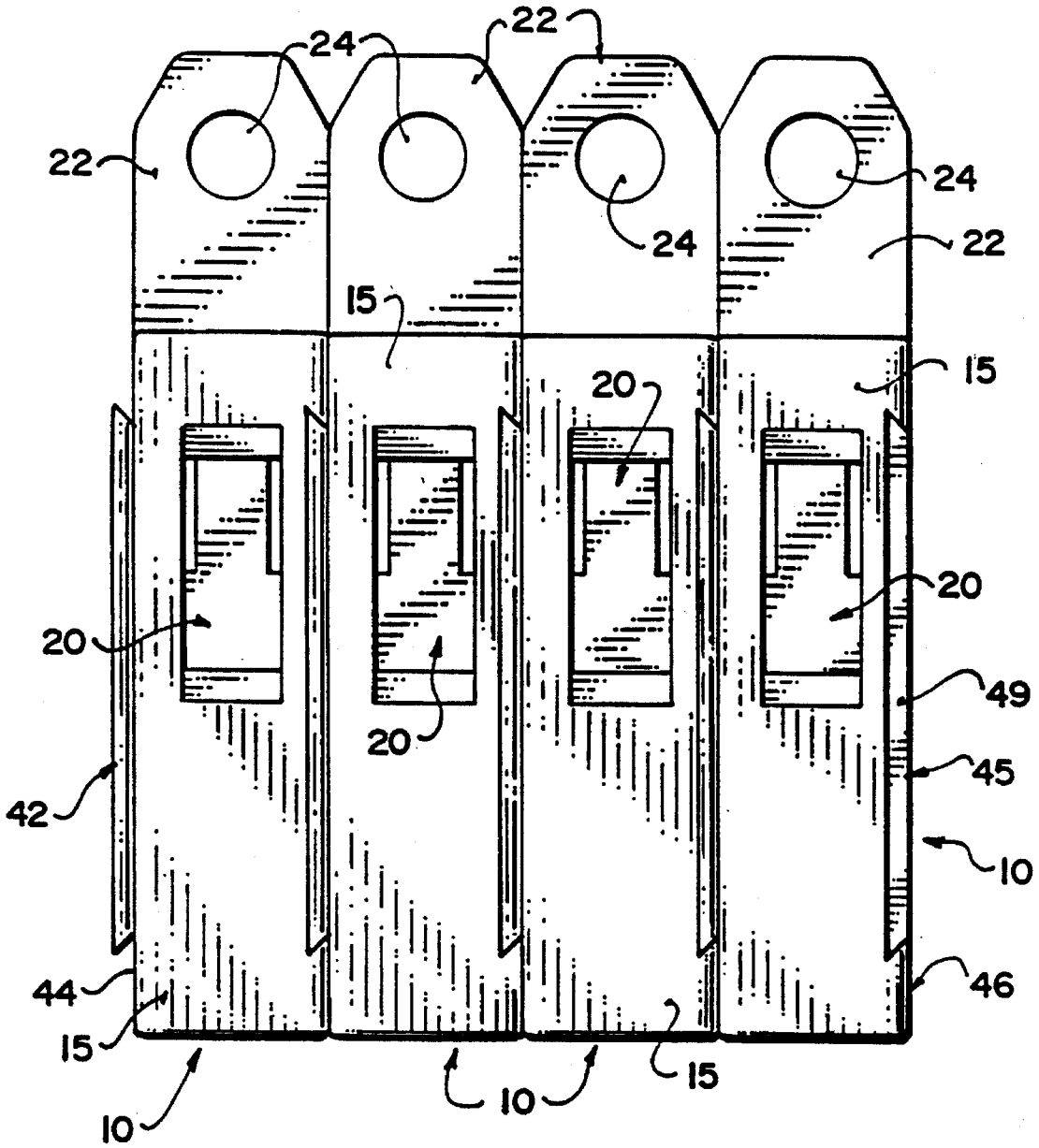
FIG. 2 is an plan view of four bit holders according to the invention connected in series to form a set.
Figure 3:
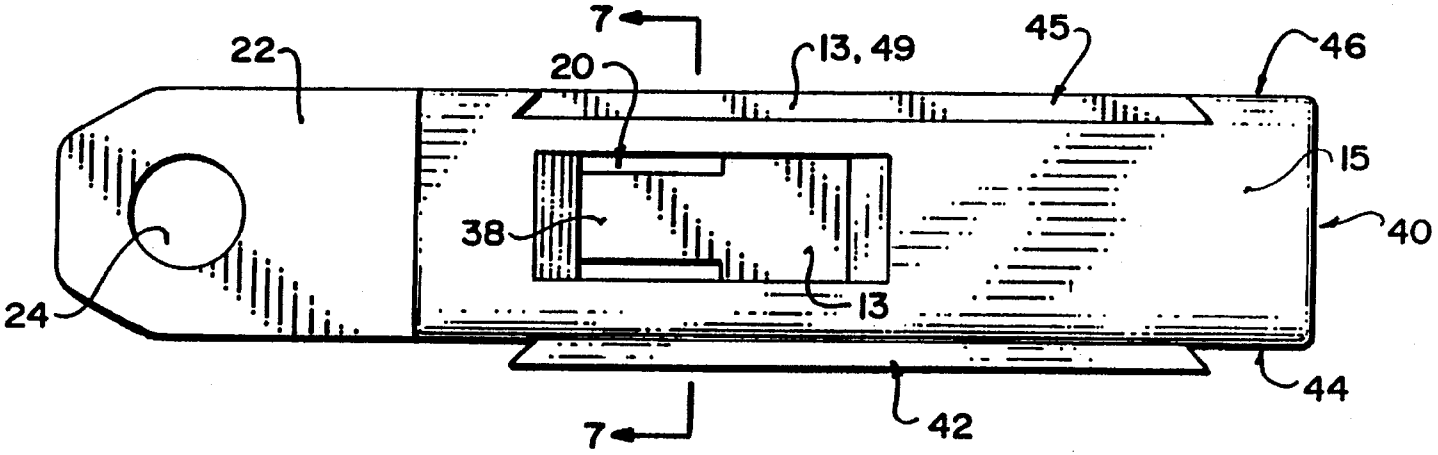
FIG. 3 is a top plan view of the bit holder of the invention shown in FIG. 1.

With reference to FIG. 1 through 3, a first embodiment of the bit holder of the invention, designed for the "stubby" type of short screwdriver bit, is designated generally by reference numeral 10. It consists of a single-piece moulded plastic body 12, preferably of a plastic such as ABS which provides a certain amount of memory for the spring portion noted below, and of a thickness about 0.19 cm. Body 12 has a rear face 13 and hollow core 14, open at either end and roughly hexagonal in cross-section, which receives a bit 16. The entire body 12 is about 5.5 cm. long. A rectangular notch 20 is cut in the front face 15 of the body 12 to form a window through which the head of bit 16 can be viewed. A flange 22 is provided with a hole 24 by means of which the holder can be hung from a peg or hook.

Figure 4:
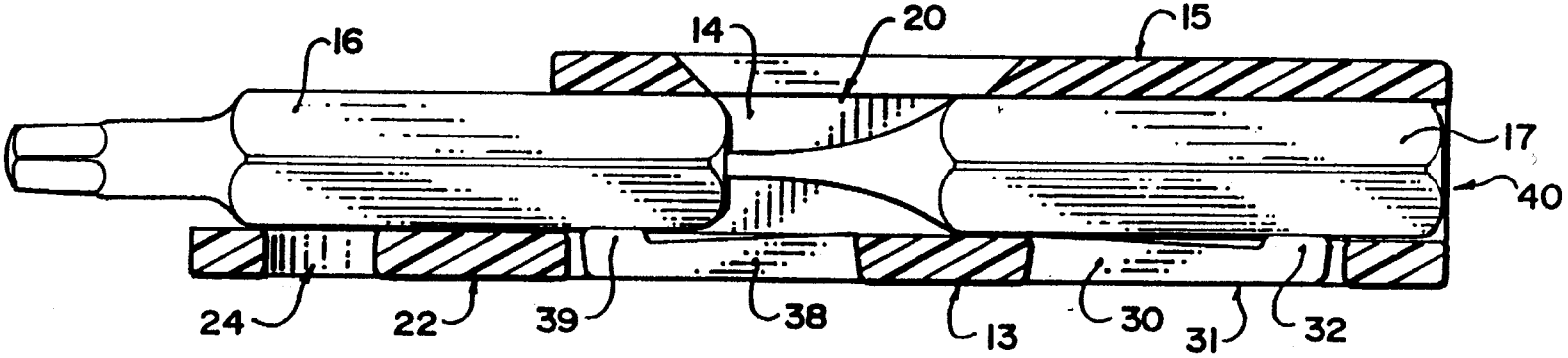
FIG. 4 is a side view of the invention in cross-section along line 4—4 of FIG. 7, with a second bit shown displacing a first bit.
Figure 5:
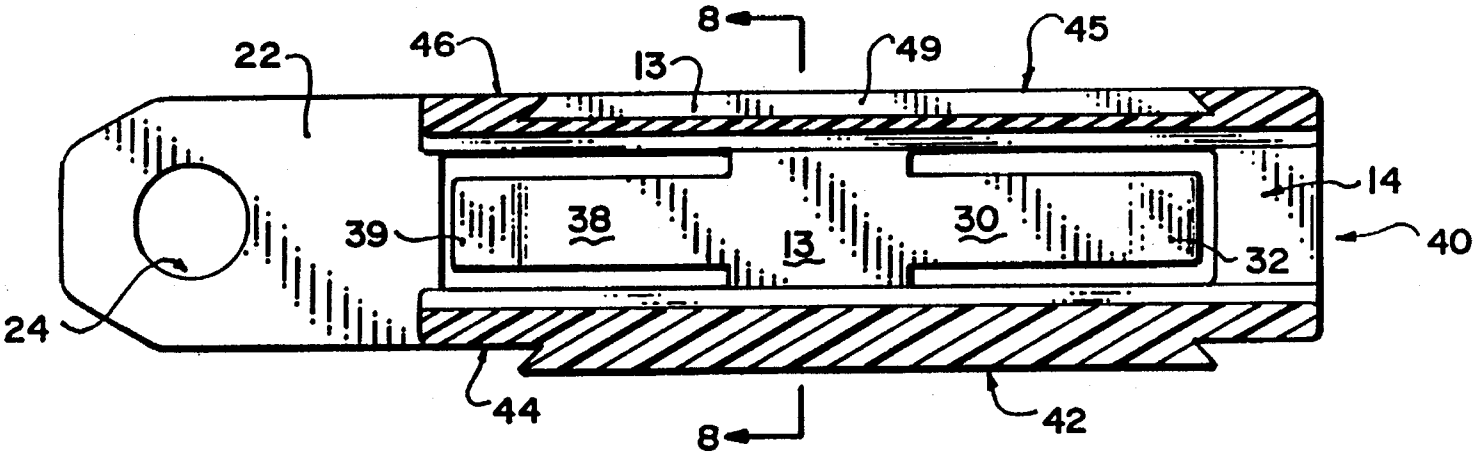
FIG. 5 is a top cross-sectional view of the invention along lone 5—5 of FIG. 8.
Figure 6:
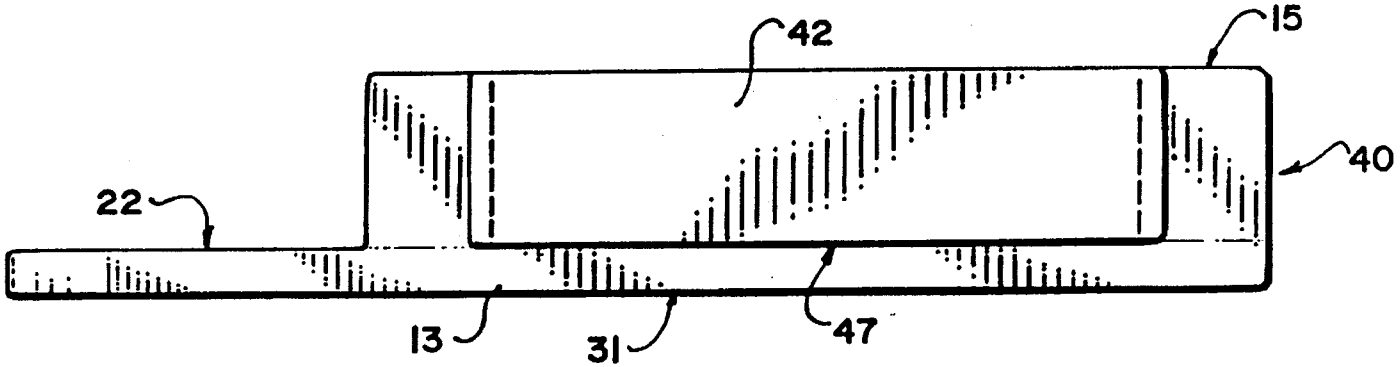
FIG. 6 is a side view of the invention as shown in FIG. 1.

The bit 16 is held in place in the central core 14 of holder 10 by a spring or flap 30 formed by slots on three of its sides in the rear face 13 of body 12. Spring 30 has a bump or dimple 32 on its inner surface. Due to the resiliency of the plastic material from which body 12 is formed, spring 30 is biased to a position in which it lies in the same plane as the rear face 13 of body 12, in which position dimple 32 extends into the interior of hollow core 14. Hollow core 14 is sized to be slightly larger in dimension than the outer dimension of bit 16 so that flap 30 is forced outwardly when the end of the bit 16 is inserted into the hollow core 14, and dimple 32 presses against the side of the bit 16. In bits such as the standard screwdriver bits used in multiple-bit screwdrivers, such as those sold under the trade-mark PIC-QUIC™ which is disclosed in U.S. Pat. No. 4,924,733, there is an annular groove adjacent one end of the bit into which dimple 32 will fit to secure the bit in place lengthwise in the holder. However, in the shorter "stubby" version shown in FIG. 4, there is no such groove, the bit is secured by friction of the dimple 32 on the side of the bit. To increase this contact, the top surface if the dimple may be flattened. Also, preferably the outer surface 31 of spring 30 is tapered so that it remains flush with the outer surface of body 12 when the bit 16 is in place.

A second flap 38 and related dimple 39 are provided on rear face 13 so that when a second bit 17 is inserted into the end 40 of the hollow core to eject the first bit 16, the second dimple 39 will bear against the side of bit 16 to secure it temporarily in the end of the holder until the user grasps bit 16 and removes it.

In operation therefore a single bit may be sold to the purchaser packaged in holder 10. The user, in order to remove the bit 16 from the package, inserts another bit or some other elongated object, into the end 40 of the hollow core, causing bit 16 to be displaced by the length of the second bit. The user then grasps and removes bit 16. The holder can be hung on a peg or the like extending through hole 24 for storage purposes.

Holder 10 is also provided with means for inter-connecting any number of similar holders into a unitary set. This means in the preferred embodiment is a sort of dovetail joint, consisting of a dovetail tenon 42, formed on side 44 of the body 12, and a complementary dovetail mortise 45, formed on side 46 of body 12. The upper edge of the mortise 45 is open so that the joint can be completed by placing the tenon 42 of a first holder 10 in alignment above the corresponding mortise 45 of a second holder and sliding the first holder downwardly so that tenon 42 slides into mortise 45, until the two holders are in the same plane and the lower edge 47 of tenon 42 abuts against shoulder 49 at the lower edge of mortise 46 formed by the upper surface of rear face 13. In this way any number of holders can be attached side-by-side, as shown in FIG. 2, and various sizes and types of bits can be combined into a single set, whether for sale or storage.

Figure 7:
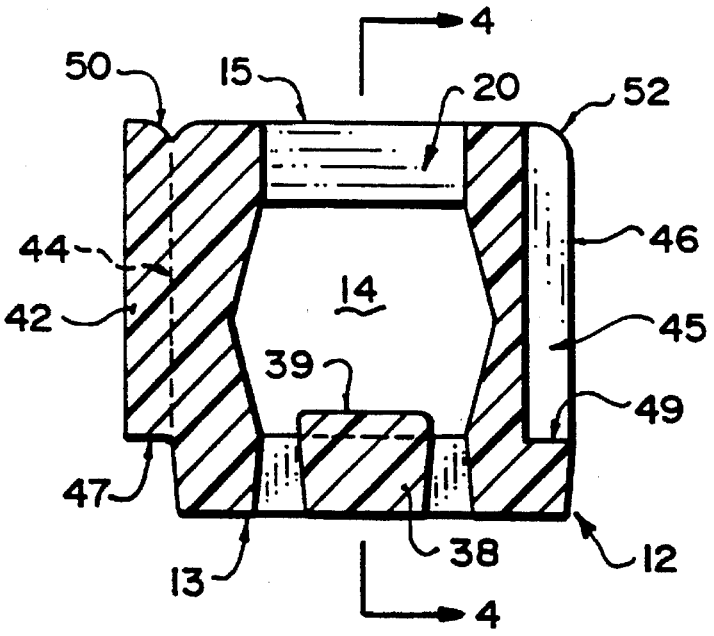
FIG. 7 is a cross-section taken along lines 7—7 of FIG. 3.
Figure 8:
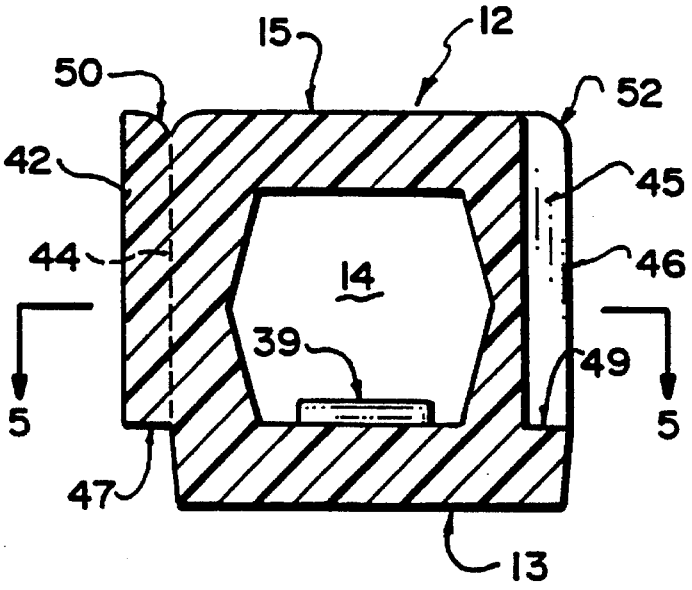
FIG. 8 is a cross-section taken along lines 8—8 of FIG. 5.

As shown in FIG. 7 and 8, the upper edge 50 of dovetail tenon 42 may be rounded to match the corresponding shoulder 52 of the adjacent holder when two holders joined.

Figure 9:
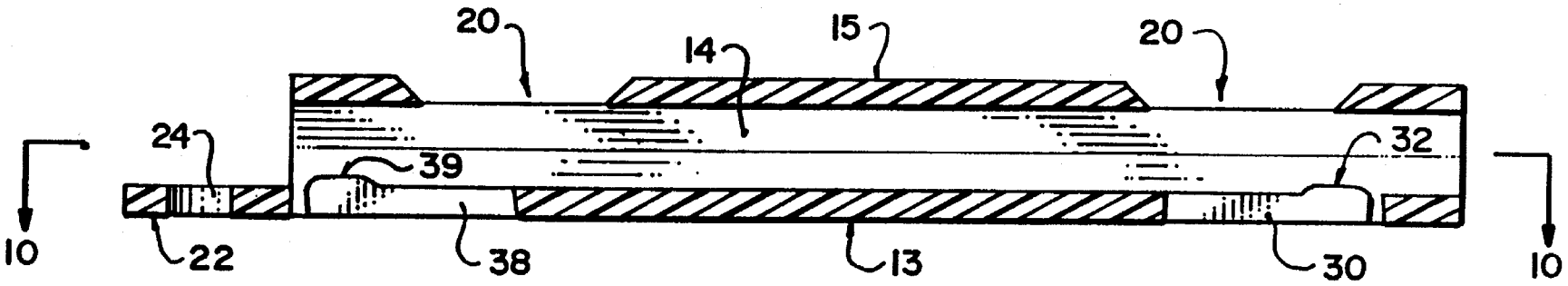
FIG. 9 is a cross-section of a second embodiment of the invention taken along lines 9—9 of FIG. 10.
Figure 10:
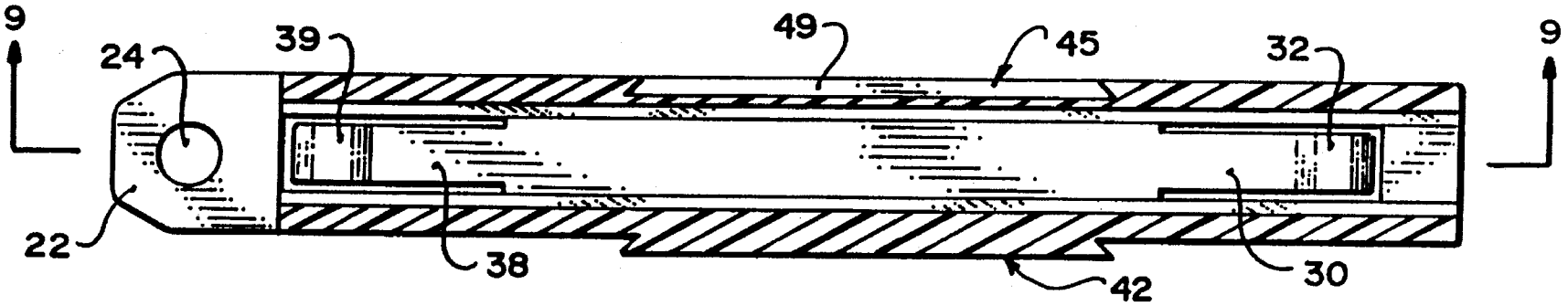
FIG. 10 is a cross-section taken along lines 10—10 of FIG. 9.

FIG. 9 and 10 illustrate a second embodiment of the invention as designed for the standard size screwdriver used in the multiple-bit screwdrivers such as those sold under the trade-mark PIC-QUIC™, in which there is an annular grove adjacent one end of the bit into which dimple 32 will fit to secure the bit in place lengthwise in the holder. In this embodiment the holder is longer, about 4 inches, with two viewing windows 20. Since the dimples 32, 39 sit in the grooves in the bits when the bits are in place, it is not necessary that the outer surfaces of springs 30, 38 be tapered to remain flush with the outer surface of rear face 13. Otherwise this embodiment functions the same as the first embodiment.

While the preferred embodiment of the invention has been described in relation to the storage of bits for multiple-bit screwdrivers, it will be apparent that the invention also has application to the storage of other types of tool bits or indeed other elongated cylindrical objects.

What is claimed is:

1. A storage container for a tool bit having a length L and diameter D, comprising:

a) a hollow body having a front wall, a rear wall, first and second side walls and first and second ends, said hollow body being open at said first and second ends, said front, rear and side walls forming a central chamber extending between said first and second ends of said hollow body having a diameter greater than D and a length greater than L for receiving and enclosing a single tool bit:

b) first means positioned in said central chamber for releasably retaining a tool bit in a first position in said chamber adjacent a first end of said chamber;

c) second means for releasably retaining a tool bit in a second position in said central chamber at a distance greater than L from said first end of said chamber; and d) means provided on each of said first and second side walls for releasably securing each of said side walls to a wall of an adjacent tool bit storage container.

2. The storage container of claim 1 wherein said front wall is provided with an opening located so as to permit the viewing of a head of a tool bit when a tool bit is in said first position.

3. The container of claim 1 wherein said first and second means for releasably retaining each comprises a movable member biassed to protrude into the interior of said chamber and thereby make frictional contact with a tool bit located in said chamber.

4. The container of claim 3 wherein each said movable member comprises an elongated flap flexibly joining said hollow body at one end of said flap and free to move at the other end of said flap.

5. The container of claim 4 wherein each said movable member further comprises a raised protrusion on the freely moving end of said elongated flap for contacting a tool bit.

6. The container of claim 1 wherein said means for releasably securing each of said side walls to a wall of an adjacent container comprises a tenon on said first side wall of said hollow body and a mortise on said second side wall of said hollow body.

7. The container of claim 1 further comprising means for hanging said body from one of a nail, hook and peg.

8. A plurality of storage container for tool bits, each bit having a length L and diameter D, each storage container comprising:

a) a hollow body having a front wall, a rear wall, first and second side walls and first and second ends, said hollow body being open at said first and second ends, said front, rear and side walls forming a central chamber extending between said first and second ends of said hollow body having a diameter greater than D and a length greater than L for receiving and enclosing a single tool bit:

b) first means positioned in said central chamber for releasably retaining a tool bit in a first position in said chamber adjacent a first end of said chamber;

c) second means for releasably retaining a tool bit in a second position in said central chamber at a distance greater than L from said first end of said chamber; and d) means provided on each of said first and second side walls for releasably securing each of said side walls to a side wall of another of said plurality of tool bit storage containers.

9. The plurality of storage containers of claim 8 wherein said means for releasably securing each of said side walls to a side wall of another of said plurality of tool bit storage containers comprises a tenon on said first side wall of said hollow body and a mortise on said second side wall of said hollow body.

10. A storage container for a tool bit having a length L and diameter D, comprising:

a) a hollow body having a front wall, a rear wall, first and second side walls and first and second ends, said hollow body being open at said first and second ends, said front, rear and side walls forming a central chamber extending between said first and second ends of said hollow body having a diameter greater than D and a length greater than L for receiving and enclosing a single tool bit:

b) first means positioned in said central chamber for releasably retaining a tool bit in a first position in said chamber adjacent a first end of said chamber;

c) second means for releasably retaining a tool bit in a second position in said central chamber at a distance greater than L from said first end of said chamber; and d) means provided on each of said first and second side walls for releasably securing each of said side walls to a wall of an adjacent tool bit storage container;

wherein said first and second means for releasably retaining each comprises a movable member biassed to protrude into the interior of said chamber and thereby make frictional contact with a tool bit located in said chamber.

11. The container of claim 10 wherein each said movable member comprises an elongated flap flexibly joining said hollow body at one end of said flap and free to move at the other end of said flap.

12. The container of claim 11 wherein each said movable member further comprises a raised protrusion on the freely moving end of said elongated flap for contacting a tool bit.

* * * * *